US006526584B1

(12) United States Patent
Hunter

(10) Patent No.: US 6,526,584 B1
(45) Date of Patent: Mar. 4, 2003

(54) WETSUIT

(76) Inventor: John D. Hunter, 2645 Lode St., Santa Cruz, CA (US) 95062

( * ) Notice: Subject to any disclaimer, the term of this patent is extended or adjusted under 35 U.S.C. 154(b) by 175 days.

(21) Appl. No.: 09/823,621

(22) Filed: Mar. 31, 2001

(51) Int. Cl.[7] ..... B63C 11/04
(52) U.S. Cl. ..... 2/2.16; 2/2.15; 2/2.17
(58) Field of Search ..... 2/2.15, 2.16, 2.17, 2/458

(56) References Cited

U.S. PATENT DOCUMENTS

D202,976 S * 11/1965 O'Neill ..... D3/17
4,809,364 A * 3/1989 Lent ..... 2/2.1 R
4,862,517 A * 9/1989 Meistrell ..... 2/2.1 R
4,999,845 A * 3/1991 Jenks, Jr. et al. ..... 2/2.1 R
5,630,229 A * 5/1997 Machado et al. ..... 2/2.15
5,896,578 A * 4/1999 Hunter et al. ..... 2/2.15
5,898,934 A * 5/1999 Hunter et al. ..... 2/2.15

* cited by examiner

*Primary Examiner*—John J. Calvert
*Assistant Examiner*—Robert H. Muromoto, Jr.
(74) *Attorney, Agent, or Firm*—Mehlin Dean Matthews

(57) ABSTRACT

A wetsuit with a close fitting portion above the waist and a loose fitting portion below the waist is disclosed. The close fit of the upper portion provides thermal insulation and coverage in the manner of a conventional wetsuit, whereas the lower portion provides maximum freedom of movement. The wetsuit provides protection against irritation and ultra-violet radiation that is superior to the typical combination of jacket and trunks.

12 Claims, 4 Drawing Sheets

PRIOR ART

PRIOR ART

WETSUIT

BACKGROUND OF THE INVENTION

1. Field of the Invention

This invention relates to wetsuits, and in particular to wetsuits adapted for surfing.

2. Description of Related Art

Wetsuits are close fitting garments generally constructed of materials that are capable of absorbing and holding water, thereby providing a layer of thermal insulation. The functional material used in most wetsuits is an elastomeric foam with an open-cell structure. The thermal insulation derives from the close fit and the water-filled foam structure.

For reference purposes, the prior art in wetsuits can be divided into two general classes: short and long. The short wetsuit provides coverage of the upper torso but does not provide coverage of the hips and legs and is worn in combination with another garment that provides coverage of the lower torso. The long wetsuit extends below the waist to provide coverage of at least a portion of the legs.

The short wetsuit is preferred for use in warmer water where the requirement for thermal insulation of the body is not extreme and it is desirable to have maximum freedom of movement for activities such as surfing. This wetsuit is typically worn with shorts or trunks. The discontinuity between the wetsuit and the shorts or trunks can lead to rashes or more serious problems for surfers. When a gap develops between the wetsuit and the trunks, friction between the surfboard and abdomen while paddling can produce a rash.

There is also the potential for discomfort since most trunks have drawstrings, eyelets, buttons, zippers, velcro or other closures on the front that can irritate while paddling.

Although the prior art has addressed the problem of rashes on the ventral region, there has been a lack of attention to problems associated with dorsal exposure due to a gap between the wetsuit and trunks. It is well established that overexposure to solar ultraviolet radiation is a risk factor for melanoma, and the lower back is particularly problematic since inspection for warning signs is more difficult than for other parts of the body.

Although the jacket type of short wetsuit that is often worn with shorts is close fitting, a violent surf can force the jacket to ride up and hamper mobility and vision at time when they are most needed.

The long wetsuit is typically used in colder waters. Since thermal insulation is the primary purpose of the second class of wetsuit, there is typically some limitation of freedom of movement. Numerous modifications have been made to the second class of wetsuit in order to increase freedom of movement, but the modifications still produce a wetsuit that is "form fitting" or "close fitting" due to the requirement for thermal insulation.

In addition to providing enhanced thermal insulation, the wetsuits of the second class provide ultraviolet protection that is superior to the wetsuits of the first class, since coverage is provided by single garment as opposed to two garments that are not joined together. However, the long wetsuit limits freedom of movement and provides too much insulation for use in warm waters.

There thus exists a need that provides both safety and coverage that is adapted for use in warmer waters such has those often favored for activities such as surfing.

BRIEF SUMMARY OF THE INVENTION

It is thus an object of the present to provide a wetsuit that combines close fitting coverage of the upper torso with loose fitting coverage below the waist in a single garment.

It is another object of the invention to provide a wetsuit with a loose fit below the waist that maximizes comfort while paddling.

A further object of the invention is to provide ultraviolet protection to the full torso while allowing maximum freedom of movement.

DETAILED DESCRIPTION OF THE INVENTION

Figure 1A:
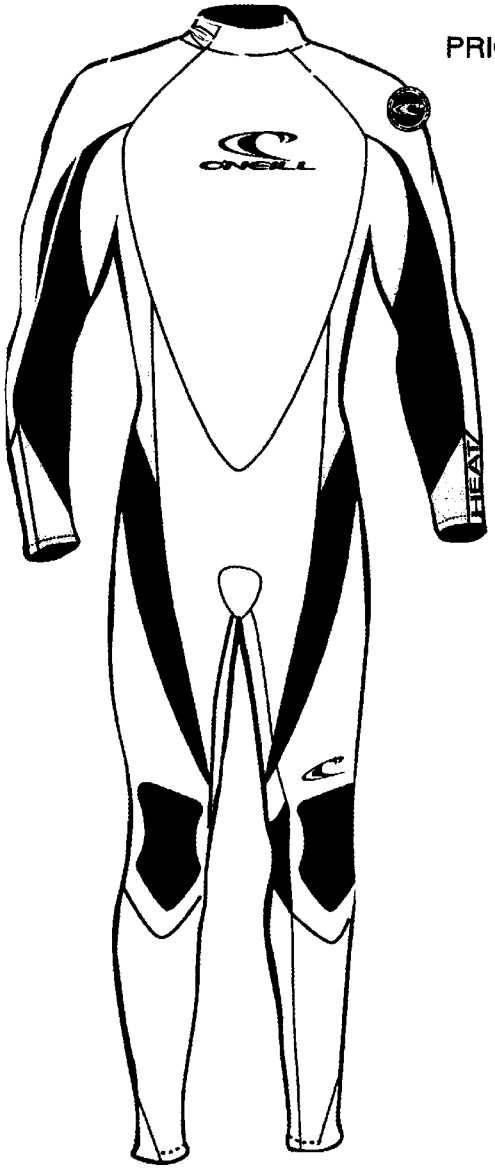
FIG. 1A Shows a front view of a conventional long wetsuit.
Figure 1B:
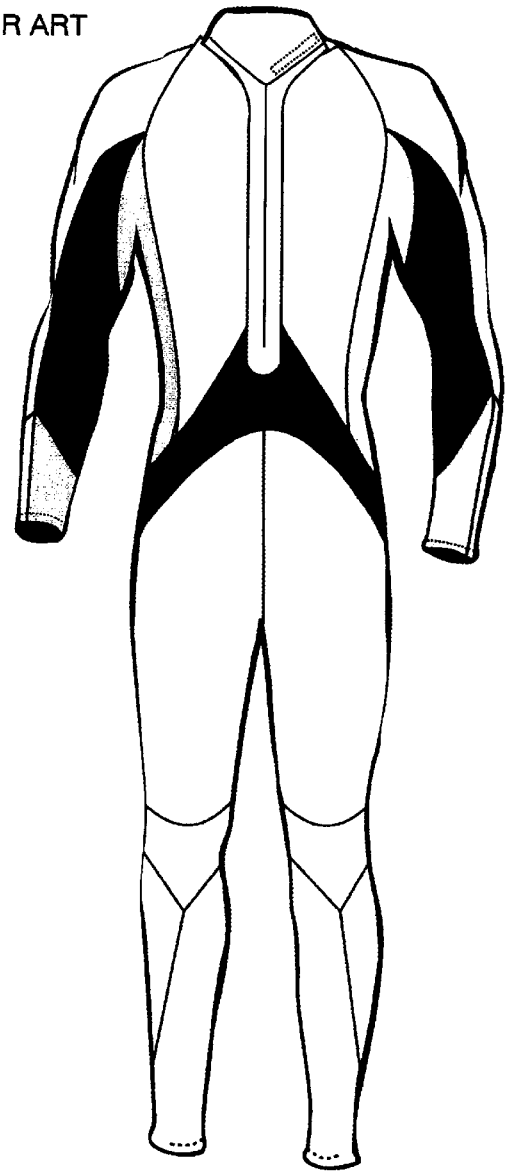
FIG. 1B Shows a rear view of a conventional long wetsuit.
Figure 2B:
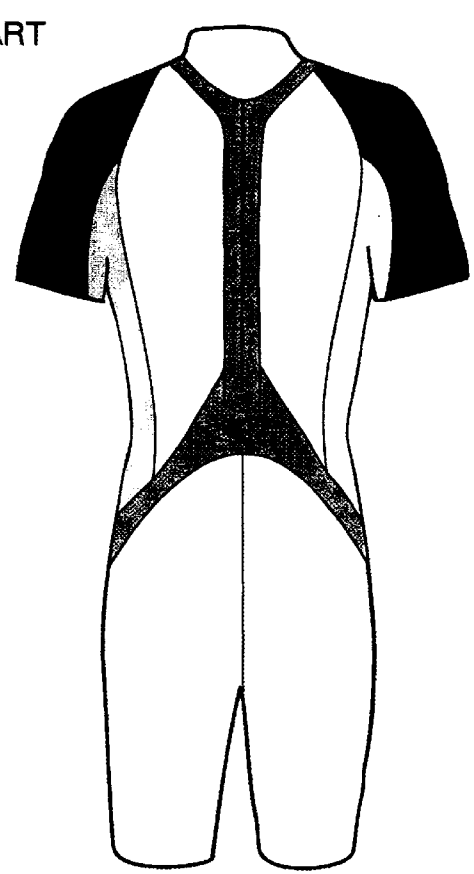
FIG. 2B Shows a rear view of a conventional short wet suit.
Figure 2A:
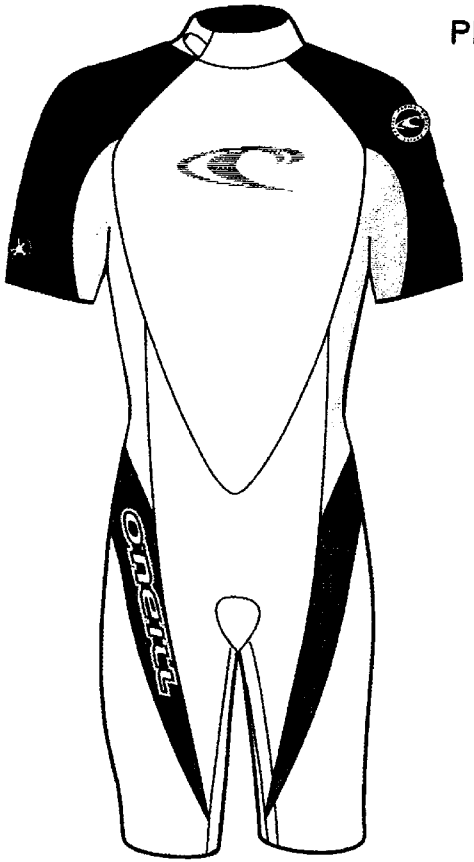
FIG. 2A Shows a front view of a conventional short wet suit.
Figure 3:
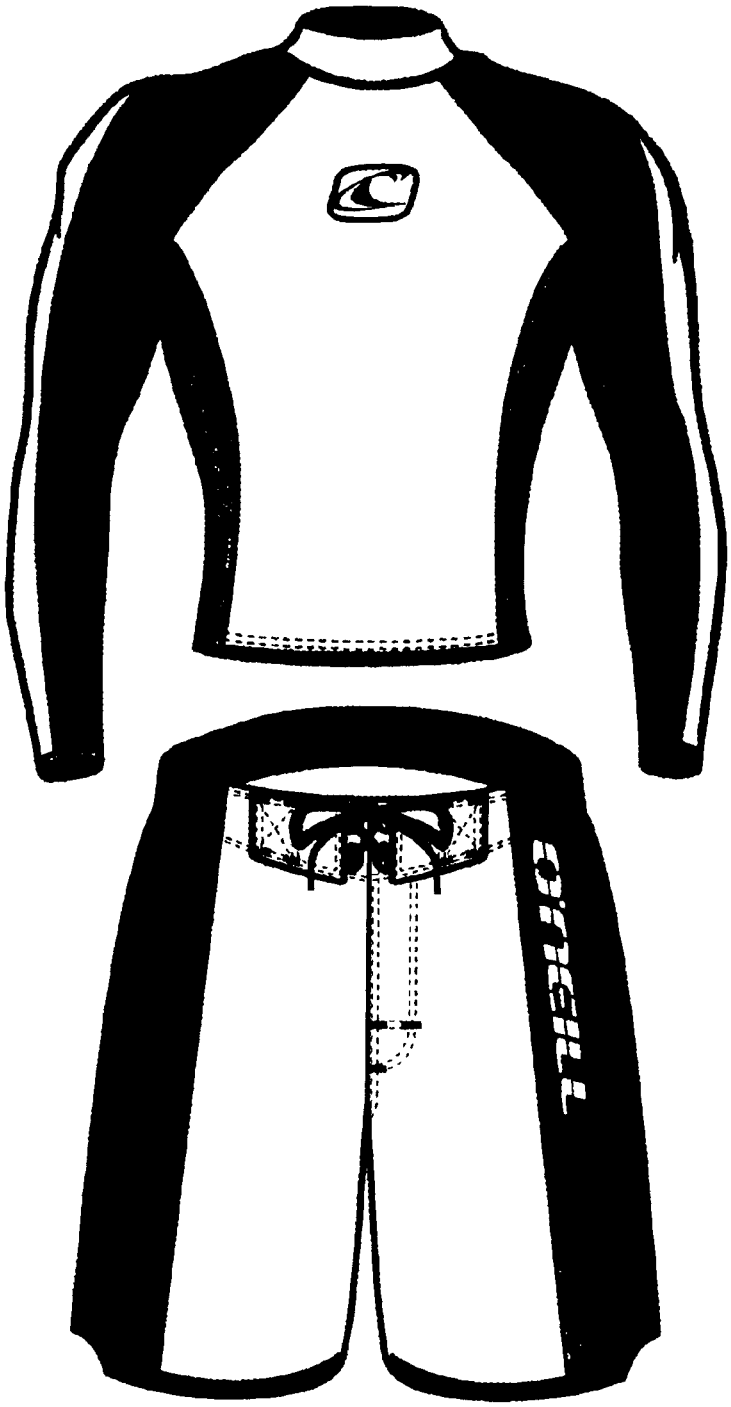
PRIOR ART FIG.3
FIG. 3 shows a conventional combination of jacket and shorts.

FIG. 1A and FIG. 1B show the front and rear views, respectively, of a conventional full body long wetsuit with a close fit and complete coverage of the legs. FIG. 2A and FIG. 2B show the front and rear views, respectively, of a conventional long wetsuit with a close fit and coverage of the thighs. FIG. 3 shows a conventional short wetsuit of the jacket type with a close fit on the torso and a separate pair of loose shorts.

Figure 4B:
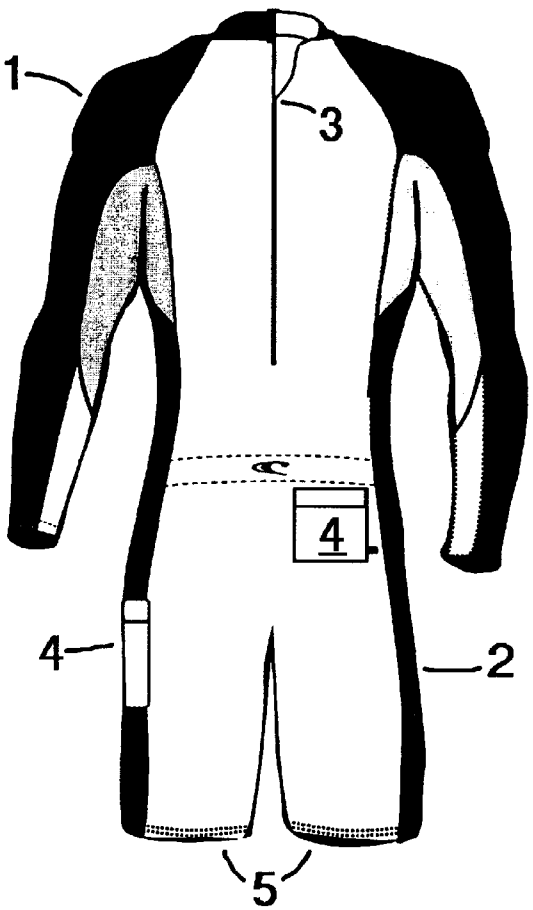
FIG. 4B shows a rear view of the present invention.
Figure 4A:
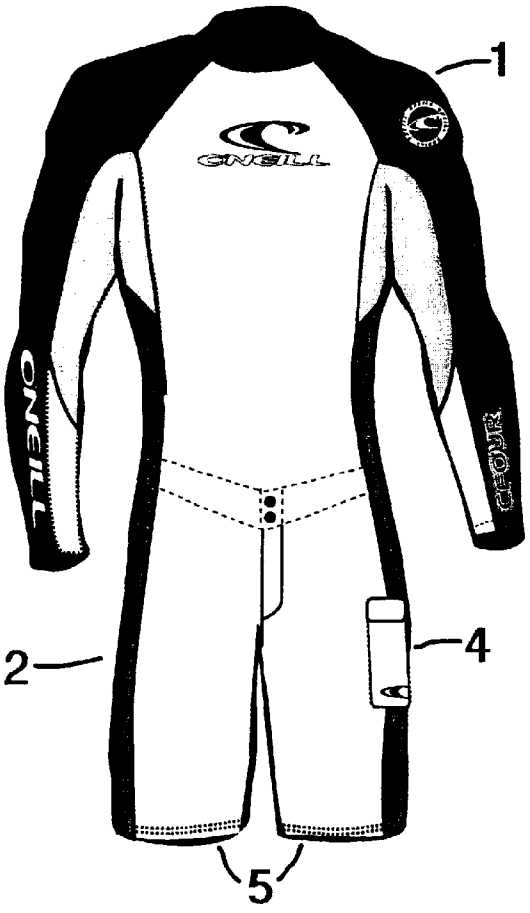
FIG. 4A shows a front view of the present invention.

The present invention is shown in FIGS. 4A and FIG. 4B. The invention is essentially the integration of a close fitting shirt portion 1 and a looser fitting trunk portion 2. The shirt portion 1 and the trunk portion 2 are continuous and inseparable during normal use. The shirt portion 1 may include a zipper 3 or other closure means to facilitate donning and removing the garment. It is preferable that the orientation of the zipper be such that the location of the zipper slider in the zipped position be such that it will not be a source of irritation during active movement such as paddling on a surfboard. A tagline may be attached to the zipper 3 to allow the wearer to work the zipper 3 without assistance.

As shown in FIG. 2A and FIG. 4B,a pocket 4 may be included in locations that will allow them to be used without being a source of irritation for the wearer while surfing.

The shirt portion 1 is preferably made of an elastomeric foam material with an open-cell construction. An example of a suitable elastomeric material is neoprene. Although the shirt portion 1 shown in FIGS. 4A and 4B has long sleeves, the shirt portion may have sleeves of any length, or may be absent altogether. The trunk portion 2 may either be made of the same material as the shirt portion 1, or it may be made of an alternate material.

The wetsuit of the present invention is close fitting to at least the navel of the wearer's body, and is loose fitting at the crotch. It is desirable that the transition between close fitting and loose fitting occur between the navel and the crotch. A close fit is defined as one in which elastic strain is introduced in the material of the wetsuit adjacent to the wearer's body. A loose fit is one in which the average circumferential gap between the wearer's body and the wetsuit is at least ⅛ inch and preferably greater than ½ inch.

In geometry, the present invention is distinguished from the prior art in that each leg element 5 of the trunk portion 2 may have a positive or zero taper. A leg element with a positive taper is one that has a circumference that increases between the crotch and the knee, i.e. the circumference of the end of the leg element near the crotch (proximal end) is smaller than the circumference of the end of the leg element that is near the knee (distal end). A leg element with a zero taper is one that has an essentially uniform circumference at and between the proximal and distal ends of the leg element.

It will be apparent to one skilled in the art that modifications to the proportions, shape, and materials of construction the may be made without departing from the scope and spirit of the invention as claimed.

What is claimed:

1. A wetsuit comprising:

a close fitting shirt portion constructed of a material providing thermal insulation when saturated with water; and a loose fitting trunk portion comprising leg elements having a zero taper.

2. The wetsuit of claim 1 wherein said material is neoprene.

3. The wetsuit of claim 1 wherein said shirt portion includes a closure means.

4. The wetsuit of claim 3 wherein said closure means is a zipper.

5. The wetsuit of claim 1 wherein said trunk portion and said shirt portion comprise different materials of construction.

6. The wetsuit of claim 1 further comprising at least one pocket.

7. A wetsuit comprising:

a shirt portion constructed of a material providing thermal insulation when saturated with water; and a trunk portion comprising leg elements having a positive taper.

8. The wetsuit of claim 7 wherein said material is neoprene.

9. The wetsuit of claim 7 wherein said shirt portion includes a closure means.

10. The wetsuit of claim 9 wherein said closure means is a zipper.

11. The wetsuit of claim 7 wherein said trunk portion and said shirt portion comprise different materials of construction.

12. The wetsuit of claim 7 further comprising at least one pocket.

* * * * *